United States Patent [19]

Smith

[11] 4,142,578

[45] Mar. 6, 1979

[54] HEAT EXCHANGER IMPINGEMENT PROTECTION

[75] Inventor: Hosea E. Smith, Baytown, Tex.

[73] Assignee: Exxon Research & Engineering Co., Florham Park, N.J.

[21] Appl. No.: 832,694

[22] Filed: Sep. 12, 1977

[51] Int. Cl.[2] ..... F28F 19/00

[52] U.S. Cl. ..... 165/81; 165/134R; 165/161

[58] Field of Search ..... 165/134, 81, 82, 161; 122/510; 110/98 R

[56] References Cited

U.S. PATENT DOCUMENTS

| | | | |
|---|---|---|---|
| 1,782,829 | 11/1930 | Nash et al. | 165/134 |
| 2,269,619 | 1/1942 | Carpenter | 165/161 |
| 2,646,818 | 7/1953 | Bimpson | 165/134 |
| 2,902,264 | 9/1959 | Schick et al. | 165/134 |
| 2,916,264 | 12/1959 | Rhodes | 165/161 |
| 3,078,919 | 2/1963 | Brown, Jr. | 165/134 |
| 3,149,667 | 9/1964 | Astrup | 165/134 |
| 3,190,352 | 6/1965 | Simpelaar | 165/134 |
| 3,472,315 | 10/1969 | Stoker | 165/134 |
| 3,545,536 | 12/1970 | Peters | 165/134 |
| 3,568,763 | 3/1971 | Stoher | 165/134 |
| 3,835,920 | 9/1974 | Mondt | 165/81 |
| 3,958,630 | 5/1976 | Smith | 165/161 |
| 3,999,600 | 12/1976 | Bell | 165/134 |

*Primary Examiner*—Charles J. Myhre
*Assistant Examiner*—Sheldon Richter
*Attorney, Agent, or Firm*—James E. Reed

[57] ABSTRACT

The tubes adjacent the shell inlet in a shell-and-tube heat exchanger or similar device are protected against erosion by the incoming shell-side fluid by tube shields which are fixed at one end to a tube sheet or baffle and slidably supported at the other end by a transverse bar or similar supporting member attached to an adjacent tube sheet or baffle. In exchangers having staggered tubes, the exposed tubes in the second row may be protected by tube shields which depend from the tube shields protecting tubes in the first row or from their supporting members and which extend adjacent the exposed tubes in the second row.

12 Claims, 8 Drawing Figures

FIG. 4.
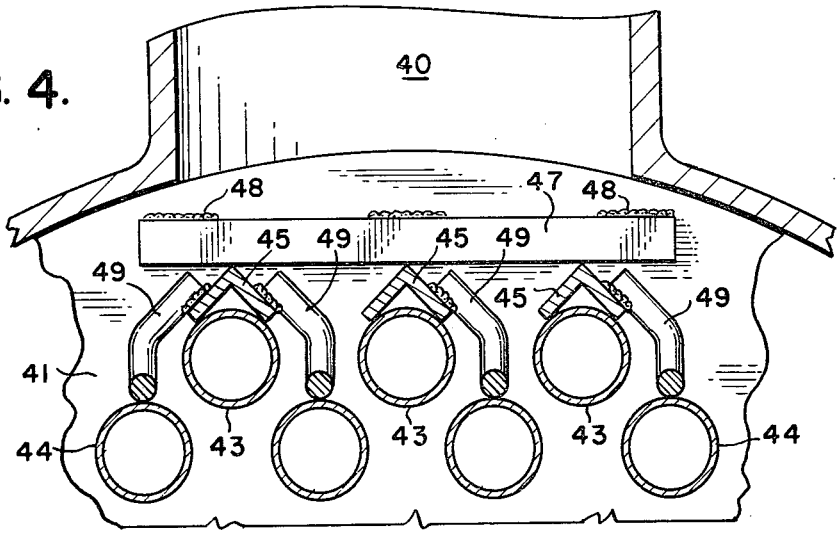
FIG. 3.
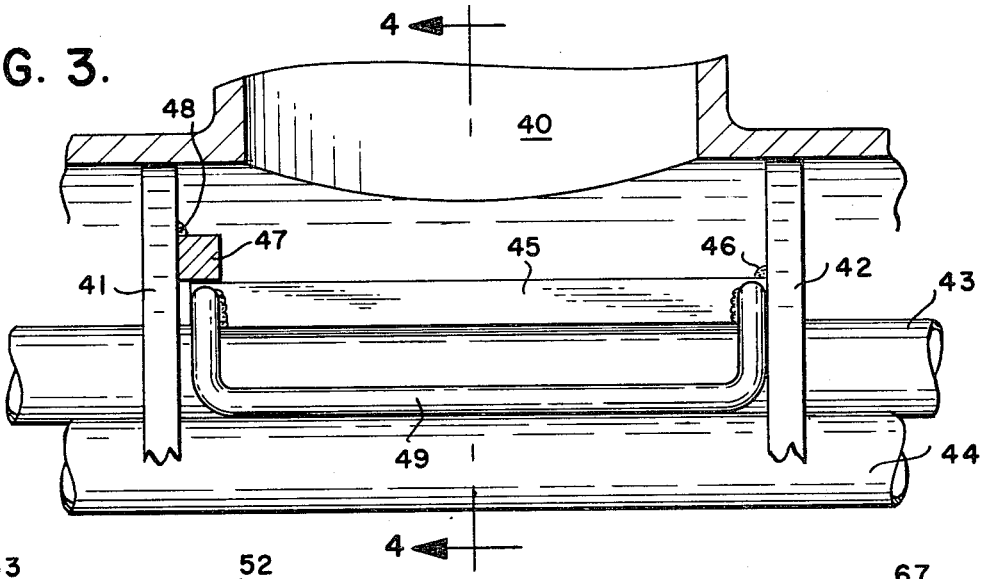
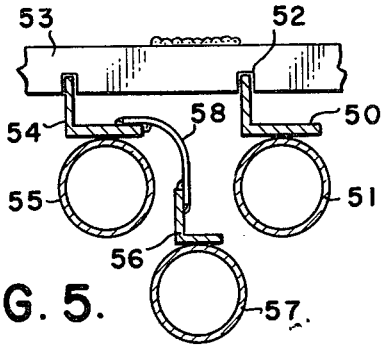
FIG. 5.
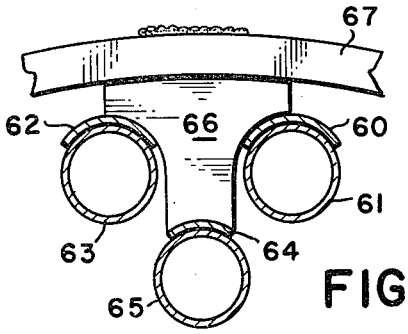
FIG. 6.
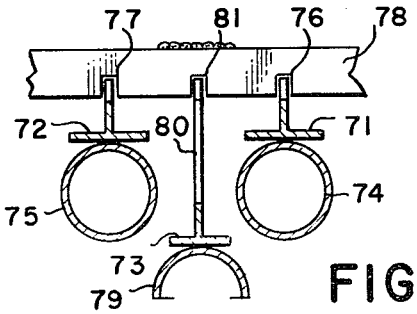
FIG. 7.
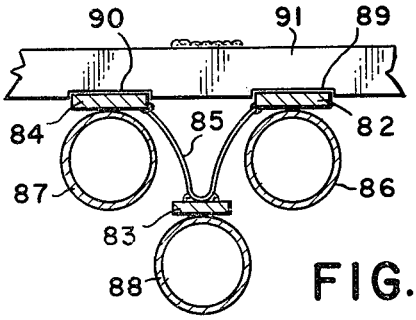
FIG. 8.

HEAT EXCHANGER IMPINGEMENT PROTECTION

BACKGROUND OF THE INVENTION

1. Field of the Invention:

This invention relates to shell and tube heat exchangers and similar equipment and is particularly concerned with an improved arrangement for protecting the tubes adjacent the shell inlet in such equipment against erosion by the incoming shell-side fluid.

2. Description of the Prior Art:

Shell-and-tube heat exchangers are widely used for the indirect transfer of heat from one fluid to another. Typically, such an exchanger consists of an external shell having inlet and outlet ports for circulation of the shell-side fluid. An elongated bundle of tubes is positioned within the shell and provided with transverse baffles for directing the shell-side fluid back and forth across the tubes. The tubes are supported by tube sheets, one of which is normally stationary and the other of which may be either stationary or "floating" to accommodate changes in tube length due to thermal expansion. The tube bundle and shell may be arranged so that the tube-side fluid makes a single pass through the shell or instead makes two or more passes. In a single pass exchanger, the tube-side fluid is introduced into a head at one end of the shell and withdrawn from a second head at the other end. In a multiple pass unit, the exchanger will generally be provided with an external head containing one or more baffles so that the tube-side fluid can be introduced into one portion of the head and withdrawn from the other portion. An internal head within which the tube-side fluid flows from one set of tubes into another will generally be located at the other end of the tube bundle. A wide variety of different shell and tube arrangements have been employed in the past.

A major problem encountered in the design and maintenance of shell-and-tube heat exchangers is that of preventing erosion on the outside of the tubes at the point where fluid enters the heat exchanger shell. The incoming fluid, which may be a liquid, a gas, or a combination of the two, normally enters the shell at high velocity and will produce rapid erosion of the tubes adjacent the inlet if it is allowed to impinge directly on them. To avoid such erosion, it is common practice to install an impingement plate or baffle between the inlet and the first row of tubes. The use of such a plate alleviates the erosion problem but requires that sufficient space be provided for the incoming fluid to move around the plate into contact with the tubes, thus reducing the number of tubes which can be installed in a shell of given size and thereby increasing the cost of the exchanger. It also distorts the fluid flow pattern, increases the pressure drop through the exchanger, and may result in "dead" spots where little heat transfer takes place and increases corrosion may occur. An alternate procedure is to install vanes or similar members in the shell inlet to partially divert the fluid so that less direct impingement occurs but such devices are often plugged by solids entrained in the fluid and at best are only partially effective. Still another procedure is to weld protective shields onto the exposed surfaces of the outer tubes adjacent the inlet to protect them against erosion. The use of such shields has alleviated erosion at the expense of increased corrosion in the weld areas.

Moreover, shields of this type cannot readily be installed on the second row of tubes in exchangers provided with triangular pitch or rotated square pitch tube bundles and hence these tubes are unprotected. As the result of these and related difficulties, none of the methods employed in the past to avoid heat exchanger tube erosion due to fluid impingement has been wholly effective.

SUMMARY OF THE INVENTION

The present invention provides an improved means for alleviating tube erosion due to fluid impingement in shell-and-tube heat exchangers which largely eliminates the difficulties outlined above. In accordance with the invention, it has now been found that such erosion can be effectively prevented by the installation on individual tubes adjacent the fluid inlet of tube shields which seat on the tubes and are secured at one end to a tube sheet or baffle and are slidably restrained on the other end by a bar or similar member fixed to an adjacent baffle or tube sheet. The tube shields employed may be constructed of angle iron, steel strips, channels, pipe segments, rods, or the like and need not be made of the same material as the tubes themselves. Any difference between the thermal expansion of the shields and that of the tubes is compensated for by restraining one end of each shield so that it can slide with respect to the tubes. Experience has shown that the use of shields mounted in this manner provides ample protection for the first row of tubes adjacent the fluid inlet against erosion due to fluid impingement, eliminates the need for impingement plates and similar devices, allows the installation of more tubes per bundle than might otherwise be used and thus reduces heat exchanger costs, avoids the necessity for welding to the heat exchanger tubes, reduces inlet fluid pressure drop, and facilitates the rapid installation and replacement of shields as necessary.

Exchangers having triangular pitch or rotated square pitch tube arrangements, unlike those having the tubes arranged in an ordinary square pitch pattern, require protection for the tubes in both the first and second tube rows adjacent the fluid inlet. The tubes in the second row of such an exhanger are protected in accordance with the invention by means of additional shields supported by the shields for the tubes in the first row or by associated supporting members. These second row tube shields may have cross-sectional configurations similar to those for the tubes in the first row and can be supported at each end by rods or other connecting members welded or otherwise connected to the first row shields. In a preferred embodiment, the second row shields are formed from rods which are bent at each end to provide arms of sufficient length to permit welding to the first row shields.

BRIEF DESCRIPTION OF THE DRAWING

FIG. 3 is an enlarged fragmentary longitudinal view of a tube bundle having triangular or rotated square pitch tubes protected against fluid impingement in accordance with the invention;

FIG. 4 is a fragmentary cross-sectional view through the tube bundle of FIG. 3 taken about the line 4—4; and FIGS. 5 through 8 are fragmentary cross-sectional views illustrating other tube shield configurations which may be employed for purposes of the invention.

DESCRIPTION OF THE PREFERRED EMBODIMENTS

Figure 1:
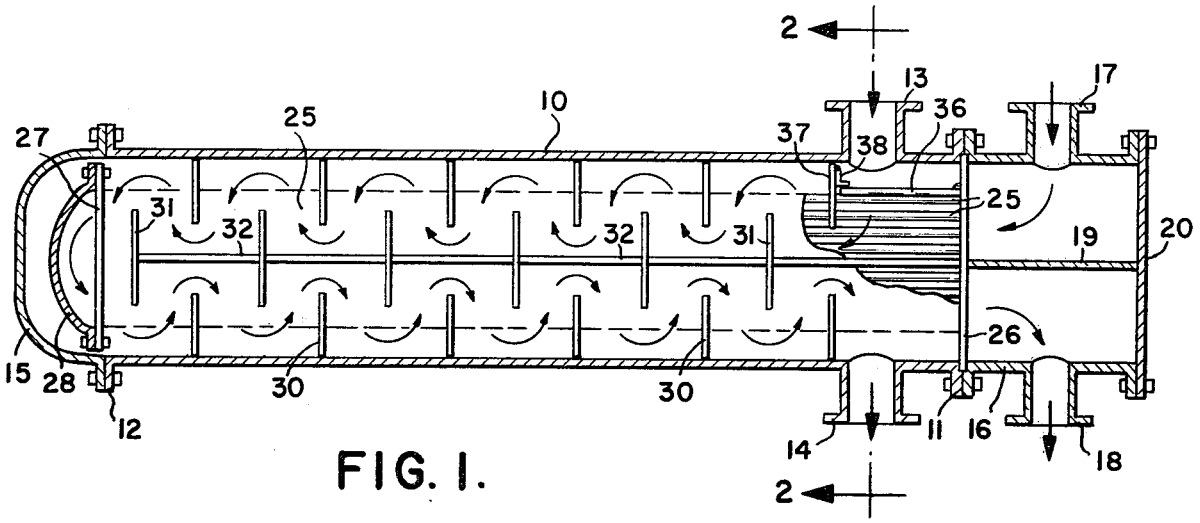
FIG. 1 in the drawing is a longitudinal crosssectional view of a shell-and-tube heat exchanger having square pitch tubes protected against fluid impingement in accordance with the invention.
Figure 2:
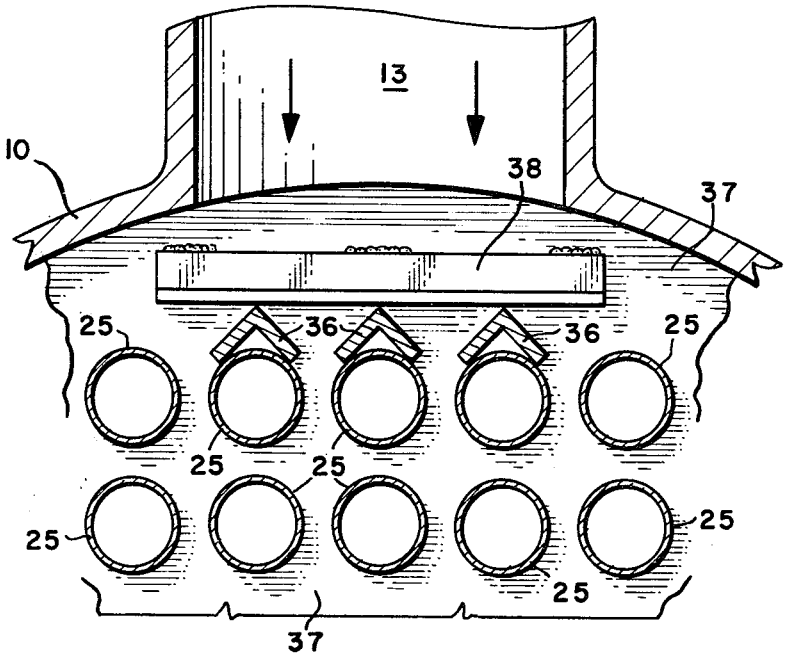
FIG. 2 is an enlarged fragmentary cross-sectional view through the exchanger of FIG. 1 taken about the line 2—2.

The heat exchanger shown in FIGS. 1 and 2 of the drawing is a multiple pass shell-and-tube unit in which the tube-side fluid makes two passes through the unit and the shell-side fluid also makes two passes. The exchanger includes an elongated, generally cylindrical outer shell 10 having an external flange 11 at one end and a similar external flange 12 at the other end. The shell includes a fluid inlet 13 located near flange 11 and an opposed fluid outlet 14 located on the opposite side of the exchanger. A flanged head 15 is connected to the end of the shell adjacent flange 12 and a heat exchanger head 16 containing a tube-side fluid inlet 17 and a tube-side fluid outlet 18 is located at the other end of the shell adjacent flange 11. Head 16 contains an internal baffle 19 which diverts the incoming tube-side fluid to permit two passes of the fluid through the tube side of the exchanger. A removable cover 20 is provided to permit access to the interior of head 16.

The tube bundle in the exchanger of FIGS. 1 and 2 comprises a plurality of elongated heat exchanger tubes 25 extending between a stationary tube sheet 26 containing openings in which the ends of the tubes are secured and a floating tube sheet 27 including similar openings in which the opposite ends of the tubes are retained. A removable floating head 28 is bolted or otherwise attached to the floating tube sheet. A plurality of transverse baffles 30 and 31 are mounted on the tube bundle to divert the shellside fluid as it moves through the shell and insure proper contact with the tube surfaces. A longitudinal baffle 32 extends between the stationary tube sheet 26 and the last transverse baffle to force the shell-side fluid to make two passes through the shell. As can be seen more clearly from FIG. 2 of the drawing, the tubes in the tube bundle are arranged in a square pitch or in-line pattern. In such a pattern, the tubes are centered at the intersections of lines extending parallel to the horizontal and vertical axes of the tube sheets.

The impingement protection system of the invention comprises a plurality of tube shields 36 positioned on the upper surfaces of the tubes in the first row adjacent the shell-side fluid inlet. As shown more clearly in FIG. 2, the tube shields in the embodiments of FIGS. 1 and 2 are constructed of angle iron or similar material. Each shield is sufficiently wide to extend over an arc of from about 90 to about 120° on the upper surface of the tube facing the inlet and sufficiently long to extend from the tube sheet 26 or baffle on one side of the fluid inlet to a point near the baffle 37 or a tube sheet on the other side of the inlet. As shown in FIG. 1, the shields will normally be somewhat shorter than the distance between the two baffles or the baffle and tube sheet to permit thermal expansion. Each shield is held in place adjacent tube sheet 26 by means of a tack weld at the end of the shield. In lieu of welding the shields in place in this manner, a bar or similar member containing notches along its lower edge for engaging and holding the shields can be welded or bolted to the tube sheet. The other end of each shield is held in place in the system of FIGS. 1 and 2 by a transverse piece of angle iron 38 or bar stock which extends outwardly over the ends of the shields and is tack welded or bolted to baffle 37. Again slots, notches or other openings may be provided in the lower edge of member 38 to engage the shields and hold them in place. Each shield is free to move longitudinally with respect to member 38 in response to thermal expansion.

The dimension of the shields employed for purposes of the invention will depend in part upon the size of the tubes in the exchanger, the material from which the shields are constructed, and the service for which the exchanger is intended. In the case of a heat exchanger containing three-fourths inch outer diameter tubes for example, shields constructed of $\frac{1}{2}'' \times \frac{1}{2}''$ angle iron will be satisfactory. Exchangers having larger or smaller tubes will require the use of correspondingly larger or smaller shields. A gap of about $\frac{1}{8}''$ will ordinarily be sufficient to accommodate thermal expansion of the shields but in some cases where exchanger temperatures are quite high, a somewhat larger gap may be needed. As pointed out earlier, the system of the invention is not restricted to the use of angular shields as shown in FIGS. 1 and 2 and instead may be carried out with shields having any of a variety of other crosssectional configurations. Similarly, although member 38 is shown in FIGS. 1 and 2 as being a straight member, it may be advantageous with some tube arrangements to employ a curved member having a radius of curvature similar to that of the baffle or tube sheet on which it is mounted.

It will be noted that the exchanger tubes in the square pitch or in-line tube arrangement shown in FIGS. 1 and 2 are aligned in the direction of flow of the incoming shell-side fluid and that only the tubes in the outer row adjacent the fluid inlet are subject to erosion due to fluid impingement. With other tube arrangements, however, the tubes in the first and second rows are normally staggered and hence may be subjected to erosion by the incoming fluid. FIGS. 3 and 4 in the drawing illustrate such a tube arrangement and the use in accordance with the invention of tube shields to protect both rows of tubes. FIG. 3 is a fragmentary longitudinal view of the upper portion of an exchanger adjacent the shell-side fluid inlet 40. Baffles 41 and 42 are positioned adjacent the inlet. Tubes 43 and 44 extend through openings in the baffles beneath the fluid inlet. Tube 43 in the first or upper row adjacent the inlet is protected against fluid impingment by an angular tube shield 45 which is positioned on top of the tube and held in place at one end by a tack weld 46 on baffle 42 and slidably secured at the other end by bar 47 tack welded to baffle 41 as indicated by reference numeral 48. The shields for the upper row of tubes in this embodiment of the invention are thus similar to those shown in FIGS. 1 and 2 of the drawing. The tubes in the second row adjacent fluid inlet 40 in the embodiments of FIGS. 3 and 4 are protected by tube shields supported by and depending from the shields of the tubes in the first row. As can be seen more clearly from FIG. 4, the shields for tube 44 comprises a rod 49 which is welded at each end to shield 45 and extends downwardly into contact with the top of tube 44 along substantially its entire length between baffles 41 and 42. As in the earlier embodiment, the shields are slightly shorter than the distance between the two adjacent baffles so that thermal expansion may take place. Each rod is bent so that it is centered on the tube beneath it and thus protects the tube against fluid impingement. Again, the size of the shield will depend in part upon the diameter of the tube to be protected. For tubes with an outer diameter of three-fourths of an inch, the use of rods with an outer diameter of about one-fourth inch or larger will ordinarily be satisfactory. As indicated in FIG. 4, the shields on the upper row of tubes may be used in some cases to support two rods for protections of the tubes in the second row.

FIGS. 5 through 8 in the drawing illustrate other tube shield cross-sectional configurations which may be employed for purposes of the invention. In the embodiment of FIG. 5, the shields are angular members positioned so that one side of the angle extends along the top of the tube. Tube shield 50, positioned on tube 51, is held in place at one end by slot 52 in bar 53. A similar slotted bar is used to restrain the shield at the other end. The bars may be welded or bolted to tube sheets or baffles. Shield 54, protecting tube 55, is supported in similar fashion. Angular shield 56, somewhat smaller than the shields used for the tubes in the first row, is positioned above tube 57 and held in place by curved arm 58 which extends between the two shields at two or more points. The arms may be made from short lengths of heavy piano wire or similar material. It is not essential, of course, that the arms be located at the ends of the shields. They can be located at two or more intermediate points if desired.

In the embodiment of FIG. 6, pipe segments formed by the longitudinal slitting of pipe or tubing slightly larger than the heat exchanger tubing are used as tube shields. Shield 60 extends longitudinally along the upper surface of tube 61. Shield 62 is positioned in similar manner on the upper surface of tube 63. A somewhat narrower shield 64 is employed to protect the upper surface of second row tube 65. These shields are held in place by plates 66 to which they are welded at their ends. The plates in turn are held in position by curved bars 67 which are welded or bolted to baffles or tube sheets on either side of the fluid inlet. The shields are sufficiently shorter than the longitudinal distance between the baffles or tube sheets to permit thermal expansion.

FIG. 7 illustrates still another embodiment of the invention in which inverted T-shaped members 71, 72 and 73 are employed as tube shields. Shields 71 and 72, positioned above first row tubes 74 and 75, are held in place at one end by slots 76 and 77 in bar 78. A similar bar is employed at the other end and the two bars are in turn supported on baffles or the like adjacent the fluid inlet. The shield 73 for the second row tube 79 is provided with vertical arms 80 which extend into slots 81.

In the embodiment of FIG. 8, flat metallic strips 82, 83 and 84 interconnected at each end by spring steel wire connecting members 85 are used to protect the first and second row tubes 86, 87 and 88. The two uppermost bars 82 and 84 seat at one end in slots 89 and 90 in bar 91 and are supported at the other end by a similar slotted bar. The interconnecting spring member 85 may be deflected slightly to accommodate any minor misalignment of the tubes and hold bar 83 firmly in place.

It will be apparent from the foregoing that a variety of different tube shield configurations can be mounted in shell-and-tube heat exchanger in accordance with the invention to protect the upper two rows of tubes against erosion due to fluid impingement. Only the first and second rows of tubes are normally exposed to impingement. As indicated earlier, the system of the invention provides effective protection against such erosion, eliminates the need for impingement plates or other conventional devices, allows the installation of more tubes per bundle than might otherwise be employed, does not require welding of the thin-wall exchanger tubes, reduces inlet pressure losses, and can be fabricated, installed and replaced as necessary at modest expense.

I claim:

1. In a shell-and-tube heat exchanger or similar device having tubes exposed to a fluid inlet located between first and second baffles or similar transverse members extending substantially perpendicular to the tubes, the improvement which comprises tube shields positioned on the exposed surfaces of said tubes adjacent said inlet, said tube shields being secured at one end to said first transverse member in substantially fixed position and being restrained at the other end but free to move longitudinally with respect to the tubes and said second transverse member, and means connected to said second transverse member for restraining said tube shields.

2. A device as defined by claim 1 wherein said tube shields comprise elongated members tack welded to said first transverse member at one end and slidably restrained at the other end by a cross member connected to said second transverse member.

3. A device as defined by claim 1 wherein said tube shields are of angular cross-sectional configuration.

4. A device as defined by claim 1 wherein said tube shields are secured at said one end by means of slots in a bar affixed to said first transverse member.

5. A device as defined by claim 1 wherein said tube shields comprise flat metallic strips.

6. A device as defined by claim 1 wherein said tube shields comprise pipe segments connected to one another by plates to which they are welded.

7. A device as defined by claim 1 wherein said means for restraining said tube shields comprises a bar containing openings into which said tube shields extend.

8. A device as defined by claim 1 wherein said tube shields are positioned on tubes in the first row of a staggered tube pattern and additional tube shields which extend along the exposed surfaces of tubes in the second row of said staggered tube pattern depend from said tube shields on said tubes in said first row.

9. A device as defined by claim 8 wherein said additional tube shields comprise rods depending from said tube shields on said first row of tubes.

10. A device as defined by claim 8 wherein said additional tube shields are connected to said tube shields on said first row of tubes by wire connecting members.

11. In a shell-and-tube heat exchanger having tubes arranged in a staggered pattern in first and second rows adjacent a fluid inlet located between first and second baffles or similar transverse members extending substantially perpendicular to the tubes, the improvement which comprises tube shields positioned on the exposed surfaces of the tubes in said first row adjacent said fluid inlet, said tube shields on the tubes in said first row being secured at one end to said first transverse member in substantially fixed position and being restrained at the other end but free to move longitudinally, means connected to said second transverse member for restraining the tube shields on the tubes in said first row, and tube shields extending along the exposed surfaces of tubes in said second row of tubes adjacent said fluid inlet and depending from said tube shields on the tubes in said first row.

12. In a shell-and-tube heat exchanger having a first row of tubes extending in the path of incoming fluid from a fluid inlet in the shell of said exchanger between a tube sheet and a transverse baffle and a second row of tubes in the path of said incoming fluid arranged in a staggered pattern with respect to said first row of tubes, the improvement which comprises tube shields positioned in the path of said incoming fluid adjacent the upstream surfaces of said tubes in said first row, said tube shields being secured in substantially fixed position but free to expand longitudinally with respect to said tubes in said first row; and additional tube shields positioned in the path of said incoming fluid adjacent the upstream surfaces of said tubes in said second row, said additional tube shields comprising rods connected to and depending from said tube shields adjacent said tubes in said first row.

* * * * *